US006220946B1

(12) United States Patent
Arnold

(10) Patent No.: US 6,220,946 B1
(45) Date of Patent: Apr. 24, 2001

(54) ACTIVE POLISHING OF ROTATABLE ARTICLE SURFACES

(76) Inventor: Philip D. Arnold, 19047 Fortuna Dr., Clinton Township, MI (US) 48038

( * ) Notice: Subject to any disclaimer, the term of this patent is extended or adjusted under 35 U.S.C. 154(b) by 0 days.

(21) Appl. No.: 09/240,311

(22) Filed: Jan. 29, 1999

Related U.S. Application Data

(60) Provisional application No. 60/074,631, filed on Feb. 13, 1998.

(51) Int. Cl.[7] ..... B24B 21/02

(52) U.S. Cl. ..... 451/307; 451/311

(58) Field of Search ..... 451/307, 296, 451/303, 311, 355, 173, 49, 489

(56) References Cited

U.S. PATENT DOCUMENTS

| | | | | |
|---|---|---|---|---|
| 1,768,339 | * | 6/1930 | Stevens | 451/306 |
| 2,560,102 | * | 7/1951 | Guinn | 451/355 |
| 3,566,549 | * | 3/1971 | Britton | 451/489 |
| 4,945,683 | * | 8/1990 | Phillips | 451/251 |
| 5,628,678 | * | 5/1997 | Tridico | 451/355 |
| 5,951,377 | * | 9/1999 | Vaughn et al. | 451/49 |

FOREIGN PATENT DOCUMENTS

| | | | | |
|---|---|---|---|---|
| 402205471 | * | 8/1990 | (JP) | 451/51 |
| 1713783 | * | 2/1992 | (SU) | 451/307 |

* cited by examiner

*Primary Examiner*—Robert A. Rose
(74) *Attorney, Agent, or Firm*—Fildes & Outland, P.C.

(57) ABSTRACT

A belt polishing machine has a moving endless abrasive coated polishing belt that wraps around and travels over a substantial portion of a circumferential surface of a rotatable workpiece for finishing the surface. A drive pulley drives the polishing belt in a continuous path at a desired surface speed over the circumferential surface of the workpiece while the workpiece is being rotated at a desired rotational speed. Guide pulleys direct the polishing belt around and into engagement with a substantial portion of the circumferential surface and may supply tension to the polishing belt during finishing operations. Separate tensioning pulleys may be provided. A coolant feed applies coolant against the polishing belt for separating and carrying away removed material from the belt and cleaning the abrasive for a subsequent pass. A backup shoe may be provided to selectively apply additional pressure through the belt upon portions of the polished surfaces to improve cylindricity. In-process gaging of the surfaces during the polishing process may also be provided.

16 Claims, 3 Drawing Sheets

FIG-1
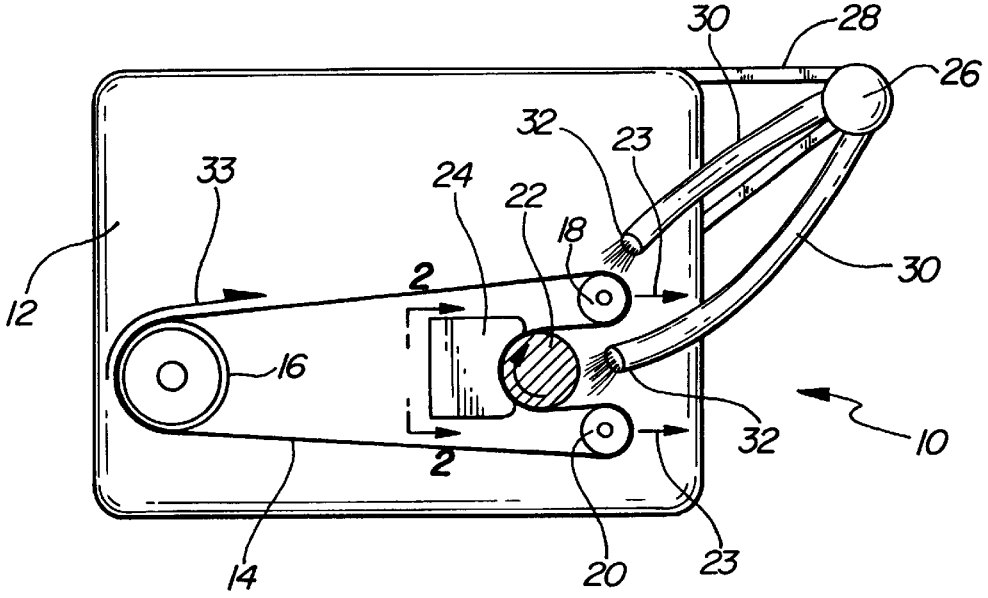
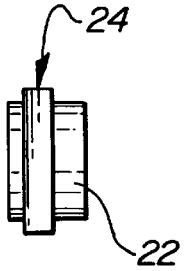
FIG-2
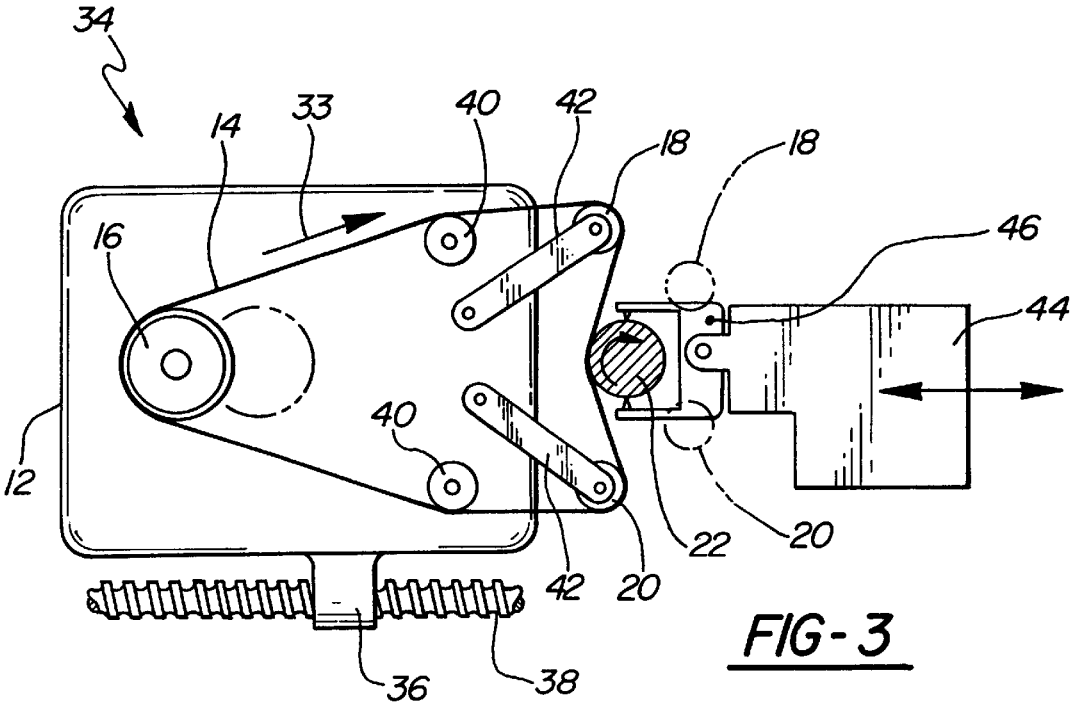
FIG-3

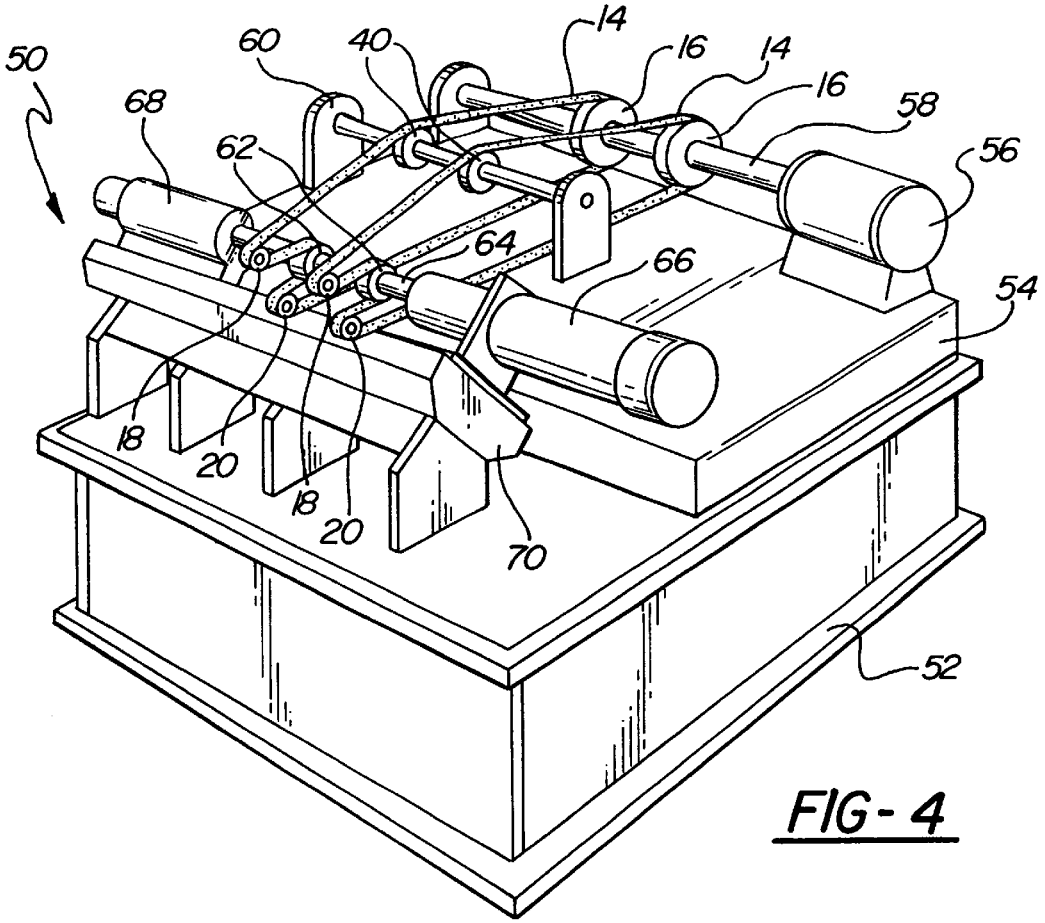
FIG-4
FIG-5
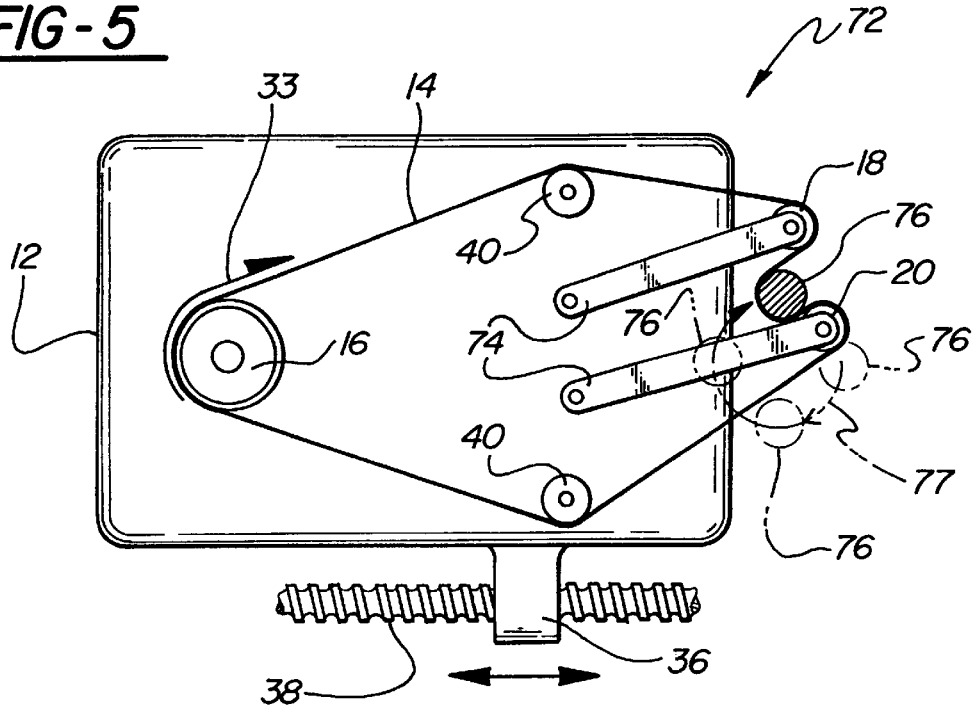

ACTIVE POLISHING OF ROTATABLE ARTICLE SURFACES

CROSS REFERENCE TO RELATED APPLICATIONS

This application claims the benefit of U.S. Provisional Application Ser. No. 60/074,631, filed Feb. 13, 1998.

FIELD OF THE INVENTION

This invention relates to precision polishing or superfinishing of surfaces of rotatable metallic articles, such as bearing journals, crankpins and cams of crankshafts and camshafts and other cylindrical and non-cylindrical articles. The material removal operations of the invention may be performed to improve surface finish, attain size or improve geometry of the finished surfaces.

BACKGROUND OF THE INVENTION

Current methods of finishing cylindrical surfaces are disclosed in numerous prior patents. For example:

U.S. Pat. No. 1,993,543 Egger shows polishing of crankshaft surfaces using abrasive tape held stationary by polishing shoes which provide force against the workpiece. Between polishing steps, the tape is advanced to provide a new abrasive surface for polishing.

U.S. Pat. No. 5,311,704 Barton II et al. shows microfinishing of bearing journals using either abrasive tape or hard abrasive inserts of various types.

U.S. Pat. No. 4,833,834 shows a traveling belt grinder for finishing cam surfaces of camshafts. An abrasive belt is driven by a drive pulley past the workpiece. A backup shoe provides force against the workpiece and guide and tension pulleys position and tension the belt. Coolant is provided to cool the workpiece and carry away removed material (sworf) from the grinding process. Subsequent polishing of the ground surfaces may be required to achieve the desired surface finish or to improve the part geometry or size tolerances.

SUMMARY OF THE INVENTION

The present invention provides an improved belt polishing machine having a moving endless abrasive coated polishing belt. The belt wraps around and travels over a substantial portion of a circumferential surface of a rotatable workpiece for finishing the surface.

Typical surfaces may comprise journals and crankpins of engine crankshafts, camshaft journals and cylindrical surfaces of other articles as well as, in some cases, camshaft cam surfaces or other non-circular surfaces. In general, the polishing machine includes drive means for driving the polishing belt in a continuous path, guide means for guiding the polishing belt around and into engagement with a substantial portion of the circumferential surface, tensioning means for applying tensioning force to the polishing belt during finishing operations, and coolant feeding means for applying coolant against the polishing belt for separating and carrying away removed material from the belt and cleaning the abrasive for a subsequent pass.

The guide means preferably include guide pulleys positioned on either side of and beyond the belt engaged surface of the workpiece to cause the belt to wrap around and engage a large portion of the surface for polishing it. The guide pulleys may also act as tensioning means or one or more separate tensioning pulleys may be employed on a polishing head carrying the main drive pulley and guide pulleys, as well as the workpiece. A backup shoe may be used to increase pressure of the belt against the workpiece, particularly where correction of the surface geometry is required.

The guide pulleys may be mounted on stationary or pivotable arms or on a pivoting carrier in order, for example, to allow oscillating motion for polishing the pins of a rotating crankshaft. Alternatively, a main and secondary polishing head may be shuttled horizontally and vertically to accomplish the same purpose.

The workpiece may be gaged in place by opening pivotal arms with the guide pulleys and retracting the main polishing head sufficiently to allow a gage means to move against and measure the workpiece while polishing continues on a lesser included angle of the circumferential surface.

These and other features and advantages of the invention will be more fully understood from the following description of certain exemplary embodiments of the invention taken together with the accompanying drawings.

BRIEF DESCRIPTION OF THE DRAWINGS

In the drawings:

FIG. 1 is a schematic side view of a first embodiment of belt polishing machine according to the invention;

FIG. 2 is a fragmentary end view from the line 2—2 of FIG. 1 illustrating the relative positioning of a backup shoe;

FIG. 3 is a view similar to FIG. 1 but showing a second embodiment of belt polishing machine including an in-process gaging feature;

FIG. 4 is a pictorial view of a base mounted belt polishing machine illustrating a third embodiment of the invention adapted for simultaneously polishing multiple surfaces on a single shaft;

FIG. 5 is a view similar to FIGS. 1 and 3 showing a fourth embodiment of the invention capable of polishing crankpins;

DETAILED DESCRIPTION OF THE INVENTION

Figure 6:
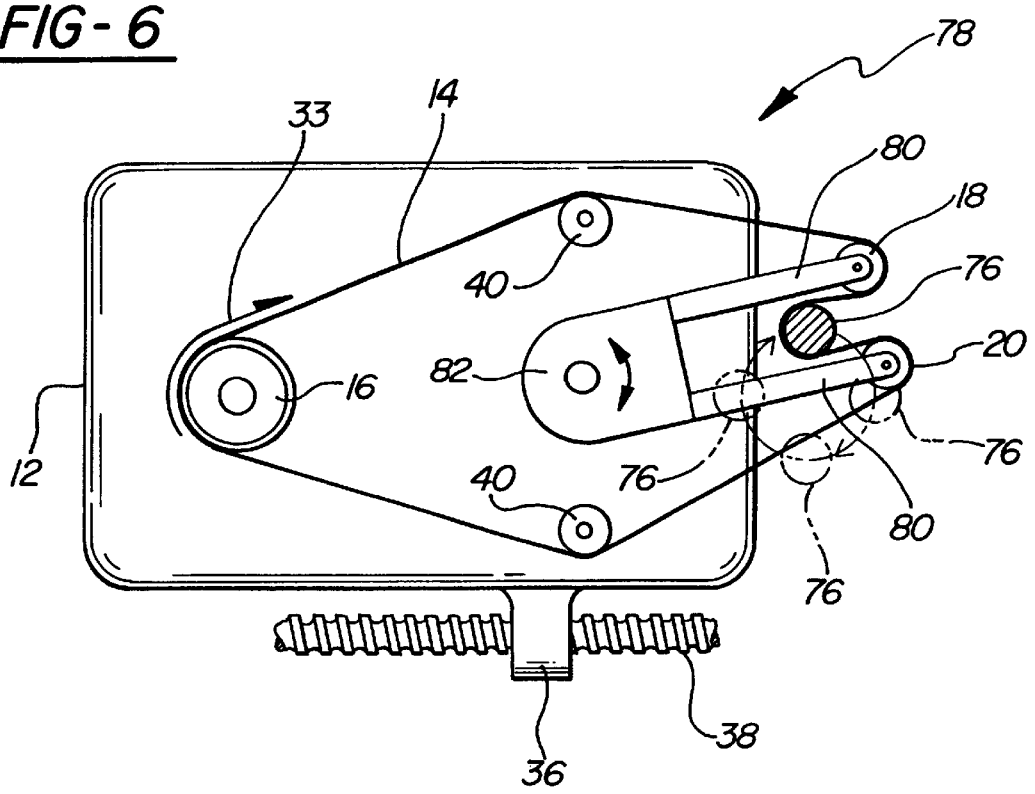
FIG. 6 is a view similar to FIG. 5 showing an alternative embodiment of crankpin polishing machine.

Referring first to FIGS. 1 and 2 of the drawings, numeral 10 generally indicates a belt polishing machine having a movable polishing head 12 carrying an endless abrasive coated polishing belt 14. Belt 14 is driven in a recirculating path by a main drive pulley 16 and passes around leading and trailing guide pulleys 18 and 20, respectively. Between the pulleys 18, 20 and offset toward the main drive pulley 16 is a cylindrical workpiece 22. A separate work table, not shown, rotatably carries the workpiece 22 and may be arranged for lateral oscillation of the workpiece relative to the polishing belt 14.

The polishing belt passes from the leading guide pulley 18 around the far side of the workpiece 22 and back to the trailing guide pulley 20 so that the abrasive coated side of the belt passes, or is wrapped, around nearly 180 degrees of the circumferential surface of the cylindrical workpiece 22. If desired, the belt wrap could be much less, possibly as low as 25 or 30 degrees, as will subsequently be more fully discussed. The guide pulleys 18, 20 also act as belt tensioners, exerting forces on the belt in the direction of arrows 23 away from the drive pulley and thus holding the belt around the cylindrical workpiece so as to exert a polishing force on the outer cylindrical surface of the workpiece 22.

A backup shoe 24, also shown in FIG. 2 of the drawings, is optionally included in the polishing machine and may be used to exert additional force against the belt to selectively apply greater polishing pressure against selected areas of the cylindrical workpiece surface in order to preferentially shape or size the surface to a desired contour. For example, the shoe could be shifted laterally to various portions of the cylindrical surface being polished so as to reduce the diameter of portions which may be excessively large or to improve the roundness of portions which may have been machined in an eccentric or non-round condition or with an imperfect axial profile, such as tapered, convex or concave, etc.

Machine 10 is additionally provided with a coolant supply including a header 26 supported by a bracket 28 to the polishing head 12 and communicating through distribution tubes 30 with nozzles 32. The nozzles are arranged to spray coolant onto the surfaces of the polishing belt 14 in a manner to separate and carry away removed material from the belt, thereby cleaning the abrasive for a subsequent polishing pass across the cylindrical workpiece surface 22.

In operation, the workpiece 22 is rotated on its axis at a desired speed which may be relatively slow and should not be so fast as to cause runout of the cylindrical surface during the polishing process. At the same time, the polishing belt is driven by the main drive pulley at a linear speed which, together with the rotation of the workpiece, provides a relative speed of the belt over the cylindrical circumferential surface of the workpiece being polished that is at or near the ideal cutting speed for the polishing process being performed.

For example, if the workpiece is rotated in a clockwise direction as shown in FIG. 1, the main drive pulley will also be rotated in a clockwise direction. This causes the belt 14 to travel in the direction of the arrow 33 so that it passes around the leading guide pulley 18, and then, in a counterclockwise direction, around the opposite side of the workpiece 22. Thereafter, belt 14 travels around guide pulley 20 to the drive pulley 16. Thus, the belt travels in a direction opposite to the surface of the workpiece 22 and the relative cutting speed of the belt is the sum of the linear travelling speeds of the two surfaces. This allows the polishing belt to be used in its most efficient manner, providing cutting at a speed best suited for the cutting or polishing operation.

The force of the belt against the workpiece is primarily determined by the force applied by the guide pulleys 18, 20 in tensioning the belt. This force, in turn, determines the rate of cutting or polishing action of the belt as it moves against the workpiece surface. If additional rounding or sizing of the workpiece surface is required, the backup shoe 24 may be applied against the outside, non-abrasive side, of the belt to apply additional cutting pressure against the workpiece. The backup shoe 24 may be laterally movable across the cylindrical surfacing of the workpiece in order to apply the additional force selectively at the locations where it is most needed. The polishing force may be increased by reducing the angle of belt wrap around the cylindrical workpiece. However, in general, an increased angle of belt wrap is better for correcting lobing and cylindricity of the polished surfaces.

Coolant is applied to the polishing belt at all times during the polishing operation through a header 26 and tubes 30. Coolant washes the abrasive side of the belt, separating and carrying away material removed from the workpiece in the polishing process and thereby cleaning the abrasive for a subsequent polishing pass across the workpiece surface. The polishing belt 14 is therefore maintained in proper condition for the effective removal of metal from the polished surface which allows the use of the belt in polishing a large number of workpieces before the belt needs to be treated or replaced.

Referring now to FIG. 3, there is shown a second embodiment of belt polishing machine generally indicated by numeral 34, and in which like numerals indicate like components. In this embodiment, the polishing head 12 is shown carrying an attached ball nut 36 which is engaged by a ball screw 38 for moving the head 12 in a fore and aft direction, toward and away from the workpiece 22. The polishing head is additionally provided with optional tensioning pulleys 40 which exert outward forces on the belt. Thus, the guide pulleys 18, 20 may be relieved of the tensioning function provided in the first embodiment of FIGS. 1 and 2, although they may also be used as tensioning pulleys, if desired.

In machine 34, the guide pulleys 18, 20 are mounted on pivotable arms 42 which are shown in solid lines in their optional outwardly pivoted positions. Dashed lines show the positions of the guide pulleys 18, 20 during the normal polishing process performed by the machine. Machine 34 is additionally provided with a gage slide 44 which carries a gage head 46 that has measuring fingers shown in position on opposite sides of the workpiece surface so as to measure or indicate the diameter of the surface during the polishing operation.

In operation, the polishing process begins with the gage head 46 and its slide 44 shifted to the right in the drawings, so that it is withdrawn from its measuring position. The polishing head 12 is also shifted to the right so that the drive pulley 16 is moved to the location shown in dashed lines indicated at 16. This also causes the polishing belt to surround about one-half of the circumference of the cylindrical surface of the workpiece 22 as the pivotable arms 42 swing inwardly and the guide pulleys 18, 20 are positioned as indicated by the dashed lines labelled 18, 20.

When the polishing process is near completion, the polishing head 12 may be retracted to the position shown. This allows the arms 42 to pivot outwardly so that the polishing belt 14 now engages only a relatively small portion of the surface of the workpiece covering an included angle of perhaps 30 degrees. This allows the gage head slide 44 to be moved inward and the fingers of the gage head to be positioned on opposite sides of the polished surface in order to measure its diameter. This measurement occurs while the polishing operation continues on the reduced portion of the cylindrical surface of the workpiece 22. Thus, gaging in process is allowed during the polishing process so that the polished surface can be accurately sized and the polishing process terminated when the desired diameter or geometrical configuration is reached.

Referring now to FIG. 4, there is shown the general layout of a complete foundation mounted belt polishing machine 50. Machine 50 includes a mounting base 52 carrying a polishing head or slide 54. Head 54 mounts a belt drive motor 56 rotatably driving a shaft 58 carrying a plurality of, in this case two, drive pulleys 16. Each of the drive pulleys 16 drives a polishing belt 14 which passes over a tensioning pulley 40 carried by a pulley support mounted on the polishing head 54. Each of the polishing belts 14 then passes around leading and trailing guide pulleys 18, 20 which are carried by means, not shown, on the polishing head 40 for movement in fore and aft fashion on the base 52.

The polishing belts 14, as in the embodiment of FIG. 1, pass around about half of a circumferential surface of a cylindrical workpiece, such as a bearing journal 62. The bearing journals 62 are carried on a workpiece 64 that is rotatably supported and driven by a work drive motor 66. The drive motor and an associated tailstock 68 are, in turn, supported by a worktable 70 on which the workpiece shaft may be moved laterally or oscillated to varying positions, as desired, for polishing various other surfaces of the workpiece shaft as required.

In operation, the polishing process is accomplished as previously described with regard to the embodiment of FIG. 1. When each polishing step is completed, the polishing head 54 is retracted, moving the polishing belts away from the polished surfaces and allowing the workpiece shaft 64 to be laterally moved to a position for polishing additional journals or other cylindrical surfaces, if desired, or to be removed completely from the machine for replacement by a new workpiece.

Figure 7:
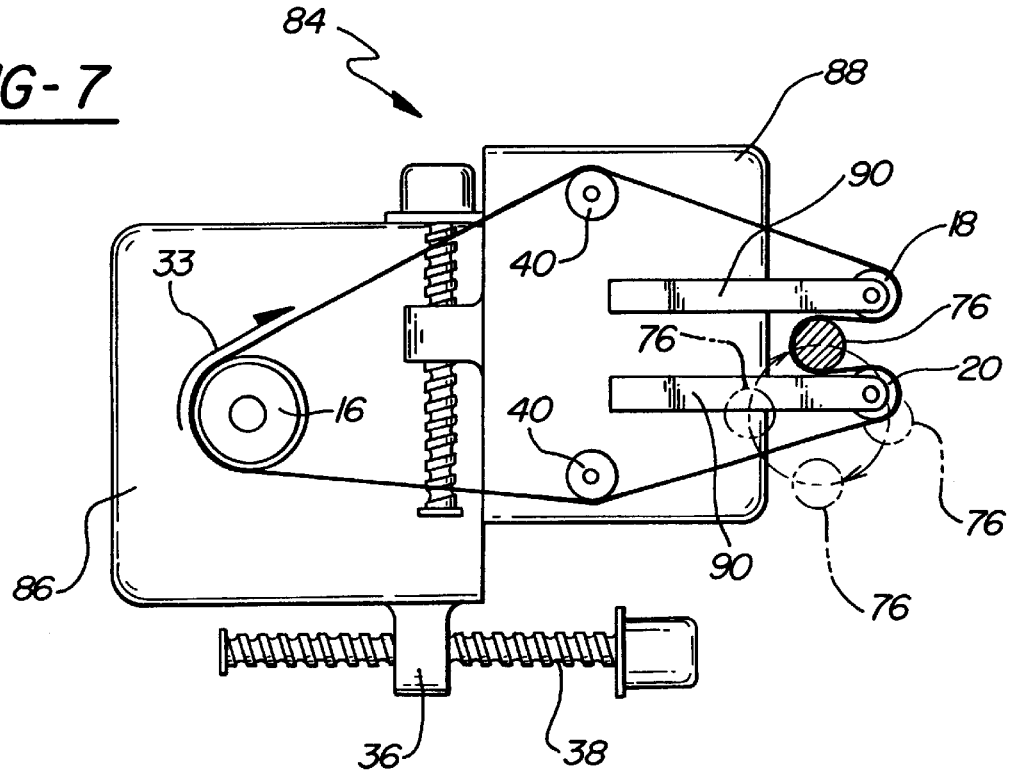
FIG. 7 is a view similar to FIG. 6 showing yet another embodiment of crankpin polishing machine.

FIGS. 5–7 illustrate various embodiments of belt polishing machines adapted especially for polishing the crankpins of crankshafts while the crankshafts are rotated in the machine. The machines can also be used to polish the main journals of such crankshafts or other shafts as shown in previous embodiments, but this process is not illustrated in FIGS. 5–7.

FIG. 5 illustrates a polishing machine 72 which is, in many respects, similar to machine 34 of FIG. 3, and wherein like numerals indicate like parts. Thus, the polishing head 12, polishing belt 14, drive pulley 16, ball nut 36, ball screw 38, and tensioning pulleys 40 are all similar to the FIG. 3 embodiment, and function in the manner there described. In addition, the leading and trailing guide pulleys 18, 20 are mounted at the ends of pivoting arms 74 which are freely movable, as will be subsequently described.

Machine 72 is arranged for polishing one or more crankpins 76 of a crankshaft, not shown. In the polishing operation, each crankpin 76 rotates around the axis, not shown, of the crankshaft from an upper zero degree position shown in solid lines to 90 degree, 180 degree, and 270 degree positions shown in dashed lines. In FIG. 5, the crankpin 76 is shown in the initial solid position with the polishing belt 14 curved about and engaging nearly half of its periphery and the pivoting arms 74 pivoted upwardly to position the crankpin 76 generally between and inward of the guide pulleys 18, 20.

In operation, the crankshaft is rotated in a clockwise direction, as shown by the arrows 77. As the crankshaft moves one quarter turn clockwise from the zero degree position shown to the 90 degree position, the pivoting arms 74 swing downward to a horizontal position through the forces exerted by the polishing belt. At the same time, the polishing head 12 is shuttled to the right in order to maintain the relative position of the guide pulleys 18, 20 with respect to the crankpin 76. Continuing clockwise motion of the crankshaft to the 180 degree position, pivots the arms 74 downward while the polishing head 12 is shuttled leftward back to the original position shown. Then the arms 74 extend at a downward angle with the guide pulleys 18, 20 on either side of and outward of the crankpin 76.

In similar fashion, continued rotation of the crankpin to the 270 degree position, pivots the arms upward to their horizontal positions while the polishing head is shuttled to the left to maintain the relative positions of the crankpin and guide pulleys. Return of the crankpin to the upper zero degree position shown in solid lines, returns the pivoting arms to the upward positions illustrated in the drawing. In this manner, the complete surface of each guide pin may be polished while the crankshaft is rotated. The polishing belt 14 travels over the surface of the rotating crankpin while the pivot arms oscillate and the polishing head 12 reciprocates so as to maintain the polishing belt 14 in the proper relation and maintain the polishing force under all positions of the crankpin.

Referring now to FIG. 6, there is shown a modified polishing machine 78 similar to that of FIG. 5, wherein like numerals are used for like parts. FIG. 6 differs in that the guide pulleys 18, 20 are carried on parallel arms 80 which are supported by a pivoting carrier 82 so that the arms are pivoted up and down together in order to cause the polishing belt 14 to polish a crankpin 76 while the crankshaft is rotating in the same manner as described with respect to FIG. 5.

Finally, FIG. 7 illustrates another modification of a polishing machine 84 in which the polishing head is separated into a main polishing head 86 which is movable in a fore and aft direction, and a secondary polishing head 88, which is movable in an up and down direction and is carried on the main polishing head. The secondary polishing head carries fixed parallel arms 90 which support the leading and trailing guide pulleys 18, 20 which guide the polishing belt 14 around a crankpin workpiece 76 in the same manner as previously described. Again, the crankpin is orbited in a circular pattern while the crankshaft rotates in a clockwise direction, and the main polishing head 80 is shuttled forward and backward as necessary to accommodate the fore and aft portions of the rotating motion, while the secondary polishing head 88 is shuttled down and up to accommodate the up and down portions of the rotating motion of the crankpin 76. In this manner, the crankpin surface is polished in fundamentally the same way as was the case for the previously described embodiments 72, 78 of FIGS. 5 and 6.

The belt polishing machine of the present invention, as exemplified by the various embodiments previously described, provides numerous advantages over previously known polishing machines. Since the abrasive coated polishing belt is continuously moved past the workpiece, it presents a constant flow of new abrasive that has the removed material or sworf constantly washed off by the cooling fluid that is always being applied. The workpiece material is removed rapidly due to the continuous active velocity of the fresh abrasive which is moved, in relation to the workpiece surface, at the most efficient cutting speed and without a buildup of sworf which is common among other polishing machine arrangements.

Optimum cutting speeds for typical abrasive grains are commonly accepted to be between 4,000 and 10,000 surface feet per minute (SPFM). In contrast, in polishing machines where the polishing action is dependent entirely on rotation of the work surface past a stationary abrasive, the relative speed is generally less than ten percent of the optimum cutting speed. The present invention also is superior in the fact that the workpiece may be rotated slowly so that vibration is avoided while the polishing belt may be moved rapidly in order to obtain the desired relative cutting speed of the belt over the polished surface.

Since the belt is constantly presenting new abrasive grits, it is not necessary to oscillate the belt or the workpiece in most circumstances, although this can be done if it is found to be necessary in a particular instance. Also, the nearly 180 degree wrap of the abrasive belt causes a natural cylindrical shaping of the workpiece. However, lesser angles of belt wrap can provide greater surface pressures and thus result in faster metal removal if desired.

Previously ground surfaces are often not truly cylindrical so that polishing with a machine of the type described here may be used to correct the cylindricity as well as to round off lobed imperfections and create a truly circular cylindrical journal or other surface. Thus, polishing with a machine according to the invention can significantly reduce cycle times for polishing crank and camshaft journals and crankpins, as well as bearing and seal surfaces and other rotatable surfaces of all shafts. This new machine provides a superior product, which is not subject to the buildup of sworf in the polishing belt that is common among other methods. The ability to back off the polishing head so as to provide for in-process gaging is an additional advantage, since the size of the polished surface may be checked and adjusted during the polishing process itself without stopping the process for gaging.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A belt polishing machine comprising:

a movable endless abrasive coated polishing belt that wraps around and travels over a substantial portion of a circumferential surface of a rotatable workpiece for finishing the surface;

drive means for driving the polishing belt in a continuous path at a desired surface speed over the circumferential surface of the workpiece while the workpiece is being rotated at a desired rotational speed;

guide means for guiding the polishing belt around and into engagement with a substantial portion of said circumferential surface, the guide means comprising guide pulleys positioned on either side of and beyond the belt engaged surface of the workpiece, the guide pulleys being carried on pivotable arms that are pivotable outward to allow gaging of the workpiece during continued finishing of the workpiece surface;

tensioning means for applying tensioning force to the polishing belt during finishing operations;

coolant feeding means for applying coolant against the polishing belt for separating and carrying away removed material from the belt and cleaning the abrasive for a subsequent pass; and gage means positioned beyond the workpiece when in the normal finishing position, said machine and the gage means being movable relative to the workpiece to move the gage means against the workpiece while the pivotable arms swing outward to permit entry of the gage means while continuing engagement of the polishing belt against a smaller portion of said circumferential surface for continued finishing of the surface during gaging of the workpiece.

2. A belt polishing machine capable of polishing crankpins of a rotating crankshaft, said machine comprising:

a movable endless abrasive coated polishing belt that wraps around and travels over a substantial portion of a circumferential surface of a rotatable workpiece for finishing the surface;

drive means for driving the polishing belt in a continuous path at a desired surface speed over the circumferential surface of the workpiece while the workpiece is being rotated at a desired rotational speed;

guide means for guiding the polishing belt around and into engagement with a substantial portion of said circumferential surface;

tensioning means for applying tensioning force to the polishing belt during finishing operations;

coolant feeding means for applying coolant against the polishing belt for separating and carrying away removed material from the belt and cleaning the abrasive for a subsequent pass;

a main polishing head mounting said drive means and said guide and tensioning means and movable toward and away from the workpiece to accommodate a fore and aft component of crankpin rotation; and secondary polishing means carrying said guide means on said main polishing head and capable of moving said guide means to accommodate an up and down component of crankpin rotation.

3. A belt polishing machine as in claim 2 wherein said secondary polishing means comprise pivotable arms.

4. A belt polishing machine as in claim 2 wherein said secondary polishing means comprises a pivotable carrier.

5. A belt polishing machine as in claim 2 wherein said secondary polishing means comprises a secondary polishing head.

6. A belt polishing machine having a moving endless abrasive coated polishing belt that wraps around and travels over a substantial portion of a circumferential surface of a rotatable workpiece for finishing the surface, said machine comprising:

drive means for driving the polishing belt in a continuous path at a desired surface speed over the circumferential surface of the workpiece while the workpiece is being rotated at a desired rotational speed;

guide means for guiding the polishing belt around and into engagement with a substantial portion of said circumferential surface, the guide means being carried on pivotable arms that are pivotable outward to allow gaging of the workpiece during continued finishing of the workpiece surface;

tensioning means for applying tensioning force to the polishing belt during finishing operations; and gage means positioned beyond the workpiece when in the normal finishing position, said machine and the gage means being movable relative to the workpiece to move the gage means against the workpiece while the pivotable arms swing outward to permit entry of the gage means while continuing engagement of the polishing belt against a smaller portion of said circumferential surface for continued finishing of the surface during gaging of the workpiece.

7. A belt polishing machine as in claim 6 wherein said guide means comprise guide pulleys positioned on either side of and beyond the belt engaged surface of the workpiece.

8. A belt polishing machine as in claim 7 wherein at least one of the guide pulleys also comprises tensioning means for forcing the belt against the workpiece.

9. A belt polishing machine as in claim 7 wherein the tensioning means comprise at least one separate tensioning pulley engaging the belt between the drive means and at least one of the guide pulleys.

10. A belt polishing machine as in claim 6 and including a backup shoe engagable with the polishing belt opposite the workpiece for forcing the belt against the workpiece surface.

11. A belt polishing machine as in claim 10 wherein the backup shoe is laterally shiftable to selectively shape portions of the workpiece surface.

12. A belt polishing machine as in claim 6 and including coolant feeding means for applying coolant against the polishing belt for separating and carrying away removed material from the belt and cleaning the abrasive for a subsequent pass.

13. A belt polishing machine having a moving endless abrasive coated polishing belt that wraps around and travels over a substantial portion of a circumferential surface of a rotatable workpiece for finishing the surface, said machine being capable of polishing crankpins of a rotating crankshaft and comprising:

drive means for driving the polishing belt in a continuous path at a desired surface speed over the circumferential surface of the workpiece while the workpiece is being rotated at a desired rotational speed;

guide means for guiding the polishing belt around and into engagement with a substantial portion of said circumferential surface;

tensioning means for applying tensioning force to the polishing belt during finishing operations;

a main polishing head mounting said drive means and said guide and tensioning means and movable toward and away from the workpiece to accommodate a fore and aft component of crankpin rotation; and secondary polishing means carrying said guide means on said main polishing head and capable of moving said guide means to accommodate an up and down component of crankpin rotation.

14. A belt polishing machine as in claim 13 wherein said secondary polishing means comprise pivotable arms.

15. A belt polishing machine as in claim 13 wherein said secondary polishing means comprises a pivotable carrier.

16. A belt polishing machine as in claim 13 wherein said secondary polishing means comprises a secondary polishing head.

* * * * *